United States Patent [19]

Ohashi

[11] Patent Number: 4,771,555

[45] Date of Patent: Sep. 20, 1988

[54] WATERPROOF BOOT HAVING REMOVABLE VENTILATION MEANS

[75] Inventor: Kazuo Ohashi, Tokyo, Japan

[73] Assignee: Kabushiki Kaisha Patine Shokai, Tokyo, Japan

[21] Appl. No.: 85,989

[22] Filed: Aug. 14, 1987

[30] Foreign Application Priority Data

Sep. 16, 1986 [JP] Japan ..... 61-217692

[51] Int. Cl.[4] ..... A43B 7/06; A43B 7/08; A43B 5/04

[52] U.S. Cl. ..... 36/3 R; 36/3 A; 36/117

[58] Field of Search ..... 36/117, 87, 3 R, 3 A; 128/588

[56] References Cited

U.S. PATENT DOCUMENTS

| | | | |
|---|---|---|---|
| 418,966 | 1/1890 | Welander | 36/3 A |
| 760,401 | 5/1904 | Sandmeyer | 36/3 A |
| 997,658 | 7/1911 | Duncan | 36/3 R |
| 1,223,042 | 4/1917 | Delvin | 36/3 A |
| 1,971,223 | 8/1934 | Kamrass | 36/3 A |
| 3,824,713 | 7/1974 | Vaccari | 36/117 X |
| 4,507,880 | 4/1985 | Ohashi . | |
| 4,658,517 | 4/1987 | Miyoshi et al. | 36/117 |

FOREIGN PATENT DOCUMENTS

| | | | |
|---|---|---|---|
| 102410 | 1/1926 | Fed. Rep. of Germany | 36/3 A |
| 2225202 | 12/1973 | Fed. Rep. of Germany | 36/3 A |
| 384884 | 2/1908 | France | 36/3 A |
| 54688 | 1/1950 | France | 36/3 R |
| 60-58841 | 12/1980 | Japan . | |

*Primary Examiner*—James Kee Chi

*Attorney, Agent, or Firm*—Frishauf, Holtz, Goodman & Woodward

[57] ABSTRACT

A sport boot such as ski boot which is both water-proof and air permeable and which is comprised of an outer sheath formed of thick impermeable material, frames provided integrally in suitable portions of the side, upper or sole part of the outer sheath and having hollow axial through-holes, air permeable members fitted into the through-holes and having ventilation through-holes providing ventilation between the inside and outside of the outer sheath, and water-proof air permeable sheets made of porous synthetic fabrics provided in position to cover the top ends of the air permeable members.

16 Claims, 6 Drawing Sheets

WATERPROOF BOOT HAVING REMOVABLE VENTILATION MEANS

BACKGROUND OF THE INVENTION

This invention relates to a boot and especially to a boot suited for sports such as skiing. More particularly, it relates to a boot having water-proofness and air permeability, and comprising a thicker outer sheath formed of impermeable material such as synthetic resin material.

Boots comprised of a substrate formed of soft and pliable material such as natural or synthetic leather in the shape of a boot, and an outer sheath formed of synthetic resin material and applied to the outside of the substrate, and boots formed of single layer of synthetic resin material without such boot-shaped substrate provided are known in the art. Especially, ski boots or other kinds of sport boots comprised of such air permeable substrate of soft material such as natural or synthetic leather and an outer sheath of synthetic material applied to the outside of the substrate have been proposed for reducing the manufacturing costs and heightening the durability, abrasion resistancy, air-tightness, heat retaining property and stability of the boots.

Such known boots are excellent in durability, abrasion resistance, water-proofness, heat retaining property, stability and protection of the users' feet, since the outer side of the substrate is covered with the outer sheath of synthetic resin material. However, there is a shortcoming with such boots in that the users' feet may sweat on account of poor air permeability, giving rise to a bad sweating odor.

The present invention, with a view to solving such shortcoming and inconvenience as mentioned above, has made an invention entitled "BOOT" as disclosed in Japanese patent Publication No. 60-58841, being a boot which is comprised of an air permeable boot-shaped substrate made of soft and pliable material, an outer sheath made of synthetic resin material applied in situ to the outside of said substrate, air permeable means provided in suitable portions of the sole part of said outer sheath and having ventilation through-holes providing ventilation between the inside and outside of said outer sheath, and water-proof air permeable layers of porous synthetic material provided at least to portions corresponding to said ventilation through-holes in said air permeable means between said substrate and said outer sheath, thus providing air permeablity for the boot, while retaining excellent characteristics such as good durability, abrasion resistance, air-tightness, heat retention, safety and protection of the users' feet. There is, however, a possibility of such air permeable means dropping off the boot on account of a bend or flexure that may be caused thereto when subjected to hard use. Particularly with a ski boot, in case of snow entering the boot through the mouth thereof, there arises another problem of condensation forming on the inner side of the outer sheath on account of the differential between lower atmospheric temperature and higher temperature inside the boot, giving the users an uncomfortable feeling of chilliness in their feet. It is difficult to prevent such condensation with such air permeable means.

Moreover, in cases where a water-proof air permeable layer is provided between the substrate and the outer sheath, an opening or space is then formed between said layer and the air permeable means, causing a risk of water entering the boot through such opening or space.

It is also noticed that a sport boot such as ski boot the sole of which is almost continuously pressed on the ground or snow and which has air permeable means in the sole part of the outer sheath, have further shortcomings such as insufficient water-proofness and poor heat retention in the possible case of water entering the boots through the ventilation through-holes in the air permeable means.

SUMMARY OF THE INVENTION

In consideration of the abovementioned inconvenience of the prior art, it is an object of the present invention to provide a boot which is excellent not only in durability, abrasion resistance, heat retaining property, water-proofness, stability and clean appearance, but which also contains sure ventilation means for affording air permeability to the boot without affecting its water-proofness.

Another object of the present invention is to provide a boot which, free from risk of dust or dirt entering through the ventilation means, is convenient to wear with the ventilation means being replaceable or cleansable with ease if clogged with dust or dirt.

In accordance with the present invention, there is provided a boot which is comprised of a thicker outer sheath formed of impermeable material such as synthetic resin material, frames provided integrally in suitable portions of the side, upper or sole part of said outer sheath and having hollow through-holes in their axial direction, ventilation members fitted water-tightly into said through-holes and having ventilation through-holes for ventilation between the inside and outside of said outer sheath, and water-proof air permeable sheets made of porous synthetic fabrics provided in position to cover the top end surface, which is the end surface facing the inside of the outer sheath, of said ventilation members.

BRIEF DESCRIPTION OF THE DRAWINGS

FIGS. 8 and 9 show another embodiment of the present invention, wherein FIG. 8 shows an air permeable member in plan and side view relative to a through-hole in the frame in sectional view, and FIG. 9 is a sectional view of the air permeable means fitted to the frame provided in the outer sheath in front sectional view.

FIGS. 10 and 11 shows another embodiment of the present invention, wherein FIG. 10 shows an air permeable member in plan and side view relative to a through-hole in the frame in sectional view, and FIG. 11 is a sectional view of the air permeable means fitted to the frame.

FIGS. 13 and 14 shows another modified embodiment of the present invention, wherein FIG. 13 shows the frame having two through-holes in plan and sectional view and FIG. 14 is a bottom view of the air permeable member fitted to the modified frame.

FIGS. 15 and 16 show another modified embodiment of the present invention, wherein FIG. 15 shows an permeable member split into two parts in the radial direction in plan and side view, and FIG. 16 shows the air permeable member fitted to the frame in front sectional view.

DESCRIPTION OF PREFERRED EMBODIMENTS

Figure 1:
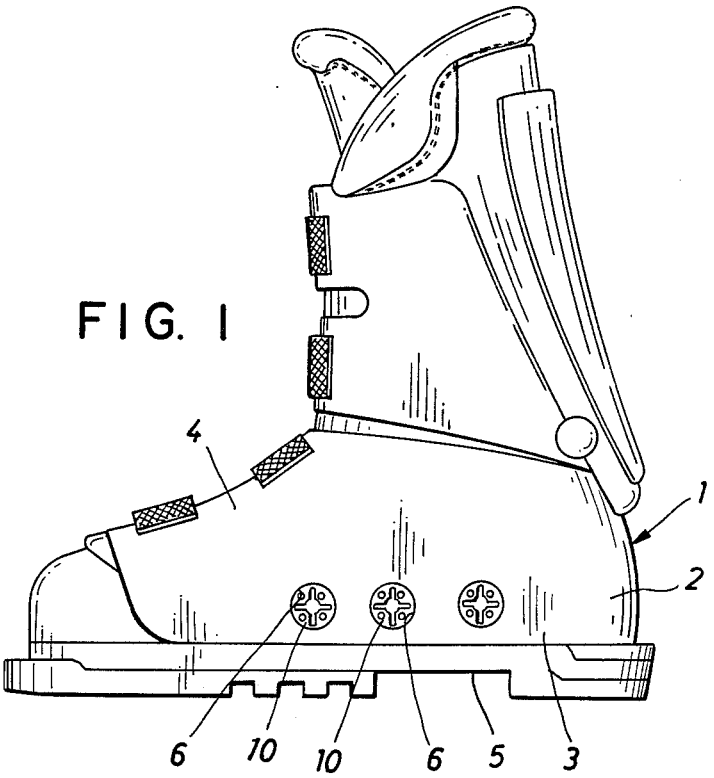
FIG. 1 is an overall side elevation of a ski boot according to the present invention.
Figure 2:
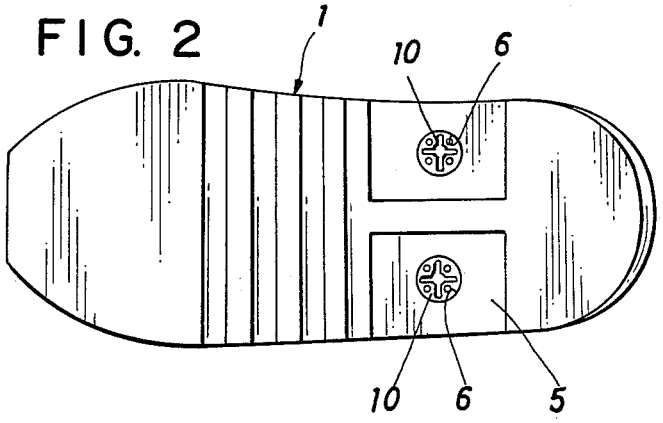
FIG. 2 is a bottom view of the ski boot.
Figure 3:
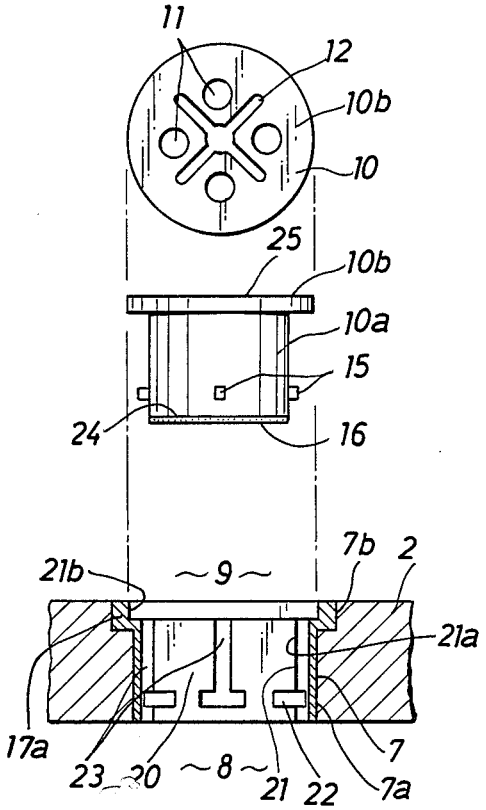
FIG. 3 shows an air permeable member in plan and side view relative to a through-hole in a frame shown in front sectional view.
Figure 4:
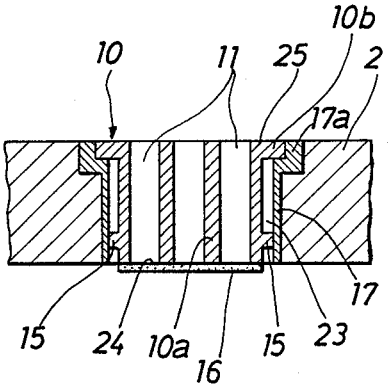
FIG. 4 is a sectional view of the water-proof air permeable means fitted to the frame provided on the outer sheath.
Figure 5:
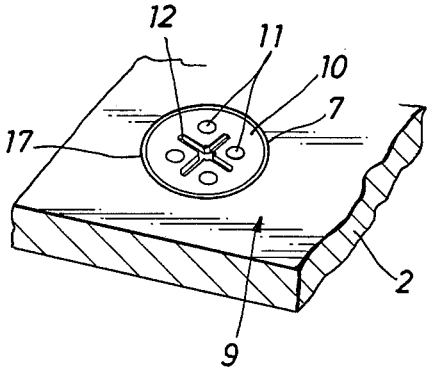
FIG. 5 is a perspective view from outside of the air permeable portion.
Figure 6:
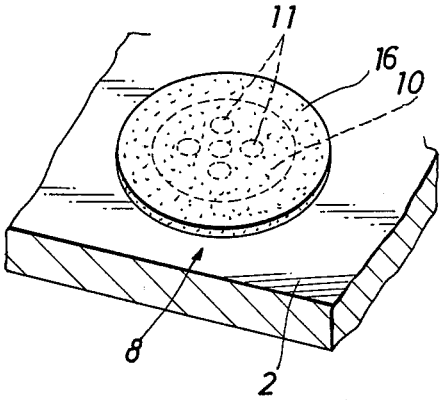
FIG. 6 is a perspective view from inside of the air permeable portion.

In the accompanying drawings, a ski boot as an embodiment of the present invention used for skiing is illustrated and generally shown in FIGS. 1 to 7 as numeral 1. The boot 1 comprises a thicker outer sheath 2 made and formed of impermeable material such as synthetic resin material. The outer sheath 2, extending to cover the user's ankles, for protection of their feet, absorbs external impact, while retaining the properties of heat retention and water-proofness of the boot 1. The boot 1 thus designed, having plural air permeable portions 6, as hereinafter described, in suitable portions of the side 3, upper 4 or sole part 5 of the outer sheath 2, provides air permeability as well as water-proofness for the boot, thereby preventing the boot from getting sweaty or giving out a bad odor even when continuously worn for long hours.

Each of the air permeable portions 6 is of the structure as shown in FIGS. 3 to 6 by way of example, wherein the numeral 7 shows a mounting hole bored through the outer sheath 2 intended to provide communication between the inside 8 and outside 9 of the boot 1. Secured into the mounting holes 7 integrally with the outer sheath 2 are repective short cylinder-shaped frames 17 (FIGS. 4 and 5) each having a hollow axial through-hole 20. The inner peripheral surface of the mounting hole 7 is so formed that it is of lesser diameter 7*a* at the inner side 8 of the boot 1 and of larger diameter 7*b* at the outer side 9, with a stepped portion integrally provided on said peripheral surface of the mounting hole 7, into which the short cylinder-shaped frame 17 having said hollow through-hole 20 provided therein is bonded or otherwise secured integrally with the outer sheath 2, the said frame 17 being so formed that its outer peripheral surface corresponds with said stepped inner peripheral surface of the mounting hole 7.

The said frame 17, made of metal or synthetic resin material, is so formed that the inner peripheral surface 21 of the through-hole 20 thereof is of lesser diameter 21*a* at the inner side 8 of the boot 1 and of larger diameter 21*b* at the outer side 9 with grooved portions 22 interruptedly provided on the inner peripheral surface 21 of the lesser diameter portion 21*a* in its inner peripheral direction and with plural guide grooves 23 extending axially from the grooved portions 22 of the inner peripheral surface 21 of the lesser diameter portion 21*a* to the border of the larger diameter portion 21*b*. Fitted into the through-hole 20 in the frame 17 is an air permeable member 10, where it is held water-tight but removable against the inner peripheral surface 21 of the through-hole 20.

The air permeable member 10, made of metal or synthetic resin material and having such outer peripheral surface as corresponds with said inner peripheral surface of the through-hole 20 in the frame 17, is formed in the overall shape of a bolt integrally with a shaft portion 10*a* which, having substantially the same outer diameter as the inner diameter of the lesser diameter portion 21*a*, is to be pressed into the lesser diameter portion 21*a* for registration therewith and with a lug portion 10*b* which likewise registers the larger diameter portion 21*b*, while provided integrally on the outer peripheral surface of the shaft portion 10*a* of the air permeable member 10 are bosses 15 which slide in registration with the guide grooves 23 in the frame 17. A multiplicity of ventilation through-holes 11 are axially bored through the air permeable member 10, while a cross groove 12 is provided on the end surface 25 of the lug portion 10*b*.

Additionally, a water-proof air permeable sheet 16 is bonded or otherwise adhered to the top end surface 24, which is the end surface facing the inner side of the boot 1, of the shaft portion 10*a* of the air permeable member 10 so that said sheet may cover the ventilation through-holes 11 on the side of said end surface 24. This water-proof air permeable sheet 16 made, for example, of synthetic fabric material of high contraction and density, having air permeable and water-proof properties, is excellent both in air permeability and water-proofness, thereby preventing the possible permeation or ingress of water from outside through the ventilation through-holes 11. Such synthetic fabric material is widely available on the market under the trademark, for instance, "SAVINA" manufactured by Kanebo Ltd.

Figure 7:
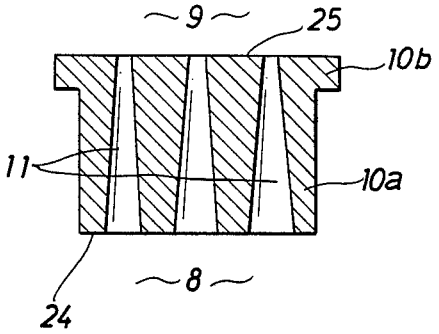
FIG. 7 is a sectional view of a modified air permeable member, in which the through-hole tapers toward end thereof.

The ventilation through-holes 11 provided in the air permeable member 10 may be of uniform diameter over the entire lenghth from the end surface 25 of the lug portion 10*b* to the top end surface 24 of the shaft portion 10*a*. However, more preferably, said through-holes 11 are bored, as shown in FIG. 7, in tapered form from the top end surface 24 of the shaft portion 10*a* towards the end surface 25 of the lug portion 10*b*. The ventilation through-holes 11 so formed not only permit better and smooth ventilation inside the boot 1 because of the change of the pressure inside said boot arising in accordance with the movement of the users' feet, but also, with the ventilation through-holes being tapered towards the outside 9 of the boot 1, prevents snow, if admitted into said boot through the mouth thereof, melting to condense on the inner side of the outer sheath 2 on account of the differential of the temperature between the inside and outside of said boot, wherein also ensured is more effective prevention of watering ingress into the inside of said boot.

The air permeable member 10 is pressed from the outside 9 of the boot 1 into the through-hole 20 and secured water-tightly to the frame 17 as follows. With the bosses 15 in the shaft portion 10*a* of the air permeable member 10 placed opposite to the guide grooves 23 in the lesser diameter portion 21*a* of the frame 17, the air permeable member 10 is pressed in the axial directicn into the through-hole 20 in the frame 17 with the bosses 15 sliding in registration with the guide grooves 23 until the bosses 15 have reached the grooved portions 22, where the air permeable member 10, with the bosses 15 away from the guide grooves 23 and engaging with the grooved portions 22, is turned clockwise or counterclockwise for its close and tight locking in the frame 17.

In this case where the air permeable member 10 can be turned with ease by using a tool such as a screw driver or a coin with its edge placed in the cross groove 12 provided in the lug portion 10*b* of the air permeable member 10, the bosses 15, disengaged from the grooves 23, may switch over to engage with the grooved portions 22. The shaft portion 10*a* of the air permeable member 10 being of substantially the same diameter as the inner diameter of the through-hole 20 in the frame 17, the air permeable member 10 fitted into the frame 17 described as above is at the same time secured water-tightly therein with the bosses also securely engaging with the grooved portions 22, thus leaving no possibility of the air permeable member 10 dropping off the boot 1 while in actual use, or of such opening or space being formed between the frame 17 and the air permeable member 10 as may admit water into the boot 1 from outside. The air permeable member 10, if desired, may be removed from the frame 17 by unscrewing the air permeable member 10 with the bosses 15 on the the air permeable member 10 being disengaged from the grooved portions 22 of the frame 17 and registering with the guide grooves 23, so that the air permeable member 10 is pressed out of the boot from the inner side 8.

Figure 8:
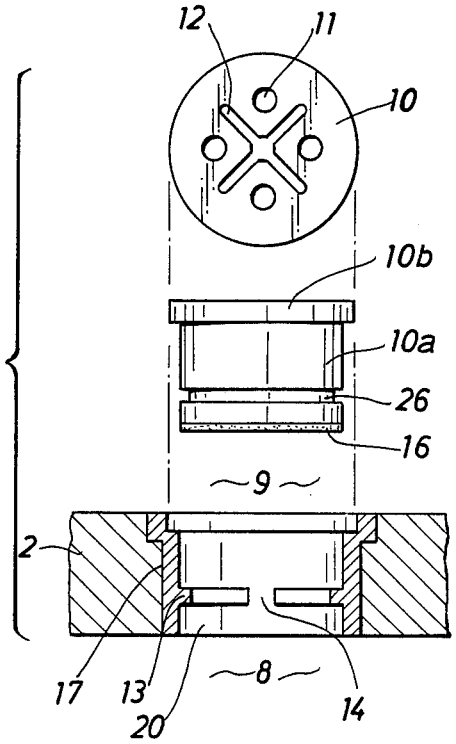
Figure 9:
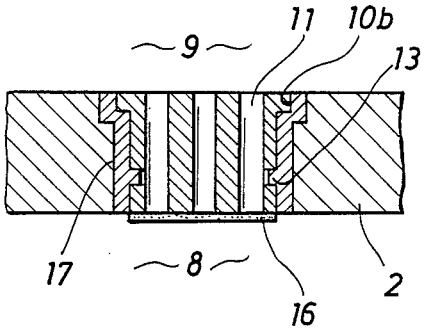

Shown and illustrated in FIGS. 8 and 9 is another example of the air permeable portion 6 of the present invention, wherein the mounting hole 7 provided in the outer sheath 2 is so formed that its inner peripheral surface is of lesser diameter 7*a* at the inner side 8 of the boot 1 and of larger diameter 7*b* at the outer side 9 with a stepped portion integrally provided on said inner peripheral surface. Bonded or otherwise secured to this mounting hole 7 integrally with the outer sheath 2 is a hollow short cylinder-shaped frame 17 having an outer peripheral surface corresponding with said inner peripheral surface of the mounting hole 7.

Said frame 17, made of soft and pliable synthetic resin material, is so formed that the inner peripheral surface 21 of its hollow through-hole 20 is of lesser diameter 21*a* at the inner side 8 of the boot 1 and of larger diameter 21*b* at the outer side with ribs 13 provided on the inner peripheral surface 21 of the lesser diameter portion 21*a* in its inner peripheral direction, said ribs 13 being interrupted by cut-outs 14 at plural points.

The air permeable member 10, pressed into the through-hole 20 in the frame 17, is held removable but water-tightly against the inner peripheral surface 21 of the through-hole 20. This air permeable member 10, made and formed of metal or synthetic resin material in the overall shape of a bolt, has an outer peripheral surface corresponding with said inner peripheral surface of the through-hole 20 in the frame 17. More particularly, the air permeable member 10 is integrally provided with shaft portion 10*a* which, having substantially the same outer diameter as the inner diameter of the lesser diameter portion 21*a*, is pressed into the lesser diameter portion 21*a* of the frame 17 for registration therewith and with the lug portion 10*b* which likewise registers with the larger diameter portion 21*b*, while also provided integrally on the outer peripheral surface of the shaft portion 10*a* of the air permeable member 10 are grooves 26 for engagement with the ribs 13. A multiplicity of ventilation through-holes 11 are axially bored through the air permeable member 10, while a cross groove 12 is provided in the end surface 25 of the lug portion 10*b*. In addition, a water-proof air permeable sheet 16 as in the preceding embodiment, is bonded or otherwise adhered to the top end of surface 24, which is the end surface facing the inner side of the boot 1, of the shaft portion 10*a* of the air permeable member, so that said sheet 16 covers the ventilation through-holes 11 on the side of said end surface 24.

This air permeable member 10, pressed from the outside 9 of the boot 1 into the through-hole 20 in the frame 17, is secured water-tight to the frame 17. More particulary, the shaft portion 10*a* of the air permeable member 10 is pressed into the lesser diameter portion 21*a* of the frame 17 in its axial direction, and, since the frame 17 having the ribs 13 integrally provided on the inner peripheral surface of its lesser diameter portion 21*a* is made of resilient synthetic resin material and such ribbed portion 13 is interrupted by plural portions 14 at predetermined points, said ribbed portion through its resiliency yields in the direction of the portions 14 and bends towards the inner side 8 of the boot 1, while the shaft portion 10*a* is being inserted, until the top end of the shaft portion 10*a* has been inserted to a certain depth beyond the ribbed portion 13, with the grooves 26 in the shaft portion 10*a* and the ribbed portion then registering with each other, where the ribbed portion 13, resuming its normal state, is engaged with the grooves 26.

Figure 10:
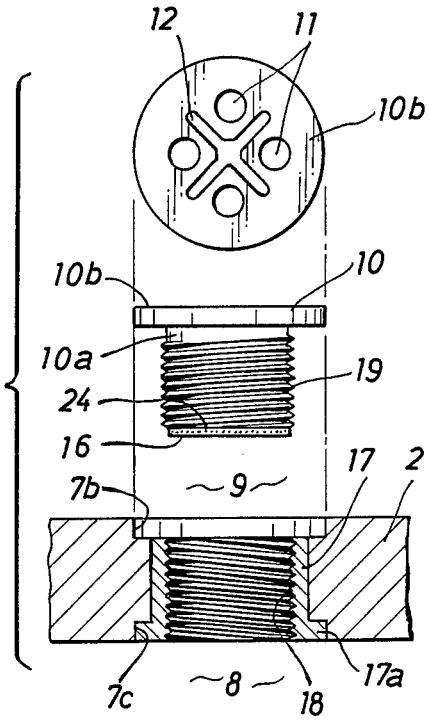
Figure 11:
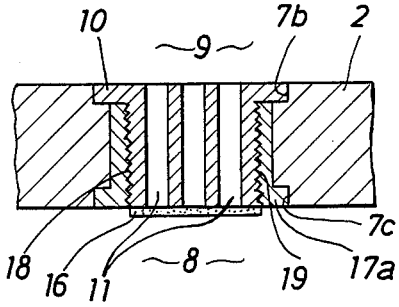

Shown and illustrated in FIGS. 10 and 11 is a further example of the air permeable portion 6 of the present invention, wherein the mounting holes 7 provided in suitable portions of the side, upper or sole part of the outer sheath 7 is so formed that it is of larger diameter 7*b*, 7*c* at both ends of the opening, the frame 17, introduced from the inside 8 of the outer sheath 2, being bonded or otherwise secured integrally to the mounting hole 7 with the flanged portion 17*a* in registration with the larger diameter portion 7*c*. The frame 17 is provided with female threads 18 integrally formed on its inner peripheral surface, while the air permeable member 10 having a muultiplicity of ventilation through-holes 11 in its axial direction is provided with male threads 19 also integrally formed on its outer peripheral surface of the shaft portion 10*a* corresponding with said fremale threads 18, so that the air permeable member 10 is secured water-tightly to the frame 17 by mating the male threads 19 with the female threads 18. Similarly to the first embodiment hereinabove, the air permeable sheet 16 made of synthetic fabric material is bonded or otherwise adhered to the end surface 24 on the side of the shaft portion 10*a* of the air permeable member 10 covering the ventilation through-holes 11 in like manner.

Figure 12:
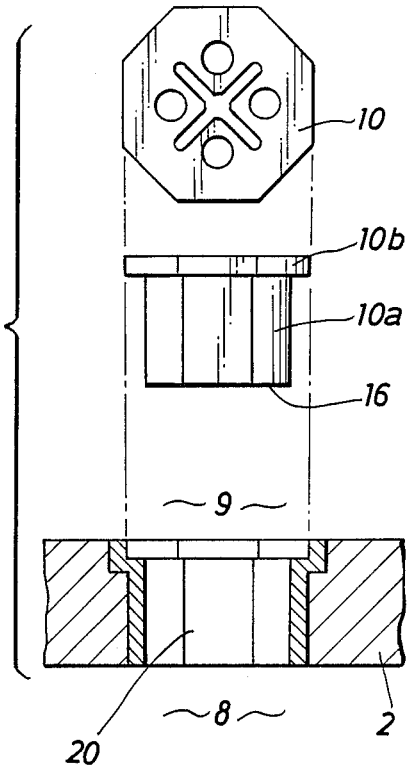
FIG. 12 shows a modified air permeable member in plan and side view relative to a through-hole in the frame in sectional view.

In each case of the embodiments described hereinabove, an air permeable member formed in the shape of a bolt having an outer peripheral surface, which is circular in cross-section, is fitted water-tightly into a hollow short cylinder-shaped frame. However, both the inner peripheral surface of the through-hole in said frame and the outer peripheral surface of said air permeable member need not necessarily be of such circular form, but may vary, for instance, to an oval or polygonal form. Shown in FIG. 12 by way of example is an air permeable member having an outer peripheral surface in polygonal form which is to be pressed into a frame having a through-hole with its inner peripheral surface correspondingly in polygonal form, such inner and outer peripheral surfaces being in registration with each other. Where an air permeable member having a polygonal outer peripheral surface is employed, as in this instance, either the outer peripheral surface of said air permeable member or the inner peripheral surface of the through-hole in said frame is preferably coated with a film of soft synthetic resin so that such film may serve as a water-seal with the result that more effective water-tightness is ensured when said air permeable member is fitted into said through-hole.

Figure 13:
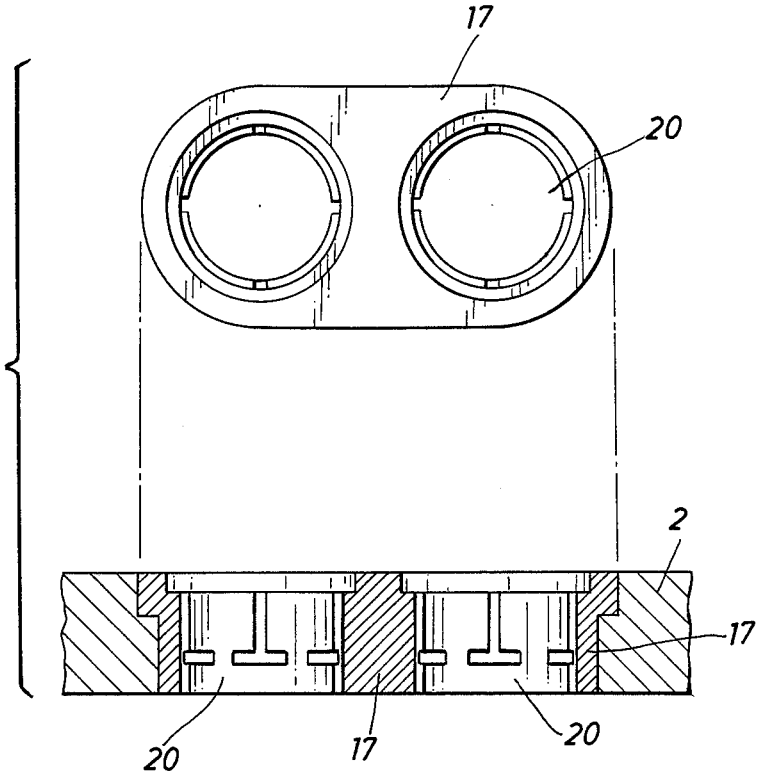
Figure 14:
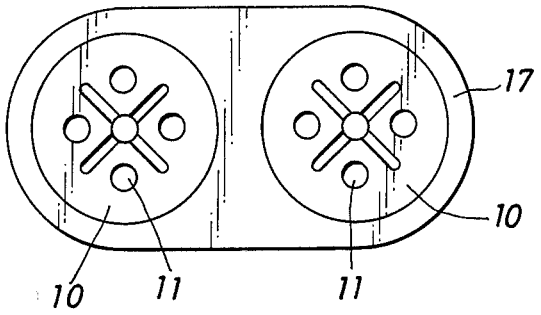

In addition, plural through-holes may be provided in each frame, as shown in FIGS. 13 and 14 by way of example, wherein a frame has two separate through-holes, and an air permeable member can be fitted water-tightly into each such through-hole.

Figure 15:
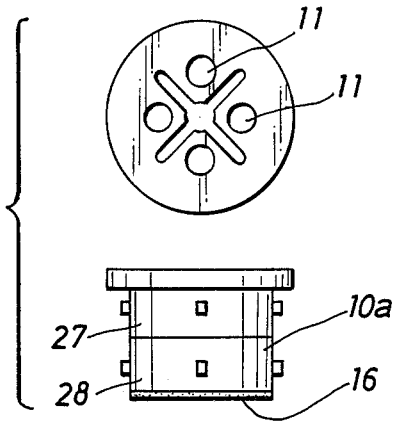
Figure 16:
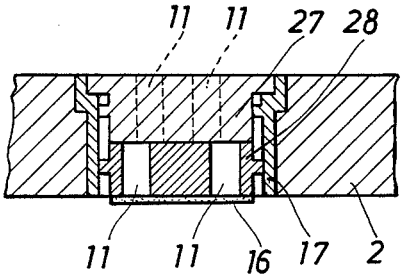

Furthermore, in FIGS. 15 and 16, there is shown an embodiment, wherein the permeable member 10 is split into two members 27, 28 by having it cut into round slices at the shaft portion 10*a*, and the permeable member in this shape is fixed into the through-holes, in said frame. Where such air permeable member composed of two members is employed as above, the ventilation of a boot can be shut off whenever so desired by turning the portion A on the outer side of the boot with said air permeable member intact in the frame.

According to the embodiments described hereinabove, frames are secured, integrally with the outer sheath of a boot, to mounting holes provided in said outer sheath. However, in cases where the outer sheath of such boot is integrally molded from plastic injection, the original molds for said outer sheath may be so processed when in the process of manufacture that the portions of said molds corresponding to those for receiving air permeable members in said outer sheath represent in their form and structure the respective portions of said frame so that part of said outer sheath may serve as such frame.

Although the foregoing description has been made with reference to a ski boot, the present invention is not limited to such embodiments but may be employed in a wide variety of sport boots such as ice skating boots, climbing boots and the like.

What is claimed is:

1. A waterproof boot having ventilation means, comprising:

a thick outer sheath formed of impermeable material and forming a boot having sole, side and upper portions, said boot having an inside and an outside on opposite sides of said outer sheath;

at least one frame provided integrally in a portion of at least one of the sole, side and upper portions of said outer sheath, said at least one frame and having at least one through-hole therein;

at least one separate air permeable member separately formed from said at least one frame, an air permeable member being removably and water-tightly received into each of said through-holes of said at least one frame, and each of said at least one air permeable members having a ventilation through-hole therein for providing ventilation between the inside and outside of said outer sheath, said at least one air permeable member having an end surface facing the inside of said outer sheath and said at least one ventilation through-hole terminating at said end surface; and a water-proof air permeable sheet made of a porous synthetic fabric adhered to said at least one air permeable member in a position covering the end surface thereof which faces the inside of said outer sheath and covering said at least one ventilation through-hole at said end surface.

2. The waterproof boot of claim 1, wherein said at least one through-hole of said at least one frame is an axially directed through-hole.

3. The waterproof boot of claim 1, wherein said at least one ventilation through-hole of said at least one air permeable member is tapered from said end surface to the outside of said outer sheath such that said ventilation through-hole has a larger opening area at the inside of said outer sheath.

4. The waterproof boot of claim 1, comprising a plurality of said frames, and a corresponding plurality of said air permeable members, each of said air permeable members being removably and water-tightly received in a through-hole of a frame, and each of said air permeable members having at least one of said ventilation through-holes therein.

5. The waterproof boot of claim 4, wherein each of said frames is in the shape of a short, hollow cylindrical member.

6. The waterproof boot of claim 4, wherein each of said frames has a substantially circular through-hole therein.

7. The waterproof boot of claim 4, wherein each of said frames has a substantially oval through-hole therein.

8. The waterproof boot of claim 4, wherein each of said frames has a substantially polygonal form at its outer peripheral surface.

9. The waterproof boot of claim 1, wherein said at least one frame has a plurality of said through-holes therein, each of said through-holes of said frame having a respective air permeable member removably and water-tightly received therein.

10. The waterproof boot of claim 1, wherein said at least one air permeable member has a plurality of ventilation through-holes therein for providing ventilation between the inside and outside of said outer sheath.

11. The waterproof boot of claim 10, wherein said plurality of ventilation through-holes of said at least one air permeable member are separated from each other in the axial direction.

12. The waterproof boot of claim 1, further comprising engaging means on at least one of said frame and air permeable member for removably locking said air permeable member to a respective frame.

13. The waterproof boot of claim 12, wherein said engaging means comprises thread means on each of said frame and air permeable member for threadable engagement of said air permeable member into said frame.

14. The waterproof boot of claim 1, wherein said at least one air permeable member comprises first and second portions, each of said first and second portions having ventilation through-holes therein, and one of said portions being movable relative to the other of said portions such that in a first relative position, said ventilation through-holes of said first and second portions are in mutual communication for providing ventilation between the inside and outside of said outer sheath, and at a second relative position, said ventilation through-holes of said first and second portions are out of communication with each other, thereby cutting off said ventilation between the inside and outside of said outer sheath.

15. The waterproof boot of claim 1, wherein said at least one frame member is made of a relatively soft and pliable synthetic resin material, and wherein said at least one air permeable member is made of a harder material than that of said at least one frame member.

16. The waterproof boot of claim 1, wherein said at least one air permeable member comprises engagement means on an outer surface thereof facing the outside of said outer sheath for engagement by a removal tool for facilitating removal of said at least one air permeable member from said at least one frame.

* * * * *